US005289811A

United States Patent [19]

Covert et al.

[11] Patent Number: 5,289,811

[45] Date of Patent: Mar. 1, 1994

[54] PURGE CONTROL DEVICE

[75] Inventors: Charles H. Covert, Manchester; Joseph Fornuto, Rochester; William E. Gifford, Hemlock; Otto Muller-Girard, Jr.; Gordon R. Paddock, both of Rochester, all of N.Y.

[73] Assignee: General Motors Corporation, Detroit, Mich.

[21] Appl. No.: 58,851

[22] Filed: May 10, 1993

[51] Int. Cl.[5] ..... F02M 33/02

[52] U.S. Cl. ..... 123/520; 251/129.05; 137/599

[58] Field of Search ..... 251/129.05, 129.15; 137/599, 599.1; 123/516, 518, 519, 520, 521

[56] References Cited

U.S. PATENT DOCUMENTS

| | | | |
|---|---|---|---|
| 4,725,040 | 2/1988 | Fornuto et al. | 251/129.15 |
| 4,944,276 | 7/1990 | House et al. | 123/520 |
| 4,995,369 | 2/1991 | Cook | 123/520 |
| 5,050,568 | 9/1991 | Cook | 123/521 |
| 5,054,455 | 10/1991 | Cook | 123/520 |
| 5,060,621 | 10/1991 | Cook et al. | 123/520 |
| 5,069,188 | 12/1991 | Cook | 123/520 |
| 5,083,546 | 1/1992 | Detweiler et al. | 123/520 |
| 5,103,794 | 4/1992 | Shiraishi | 123/520 |
| 5,115,785 | 5/1992 | Cook | 123/520 |
| 5,117,797 | 6/1992 | Telep et al. | 123/520 |
| 5,199,456 | 4/1993 | Love et al. | 251/129.15 |

*Primary Examiner*—E. Rolins Cross
*Assistant Examiner*—Thomas N. Moulis
*Attorney, Agent, or Firm*—Charles K. Veenstra

[57] ABSTRACT

A purge control device for an evaporative control system comprises a single housing having two solenoid actuated valves controlling parallel orifices leading from an inlet chamber to an exit flow path. The two solenoid valves have different sized orifices to provide different flow capacities. Purge flow is controlled by an electronic control module which regulates the duty cycle of the solenoids. Each valve receives its own signal so that the flow through the orifices is individually controlled.

3 Claims, 2 Drawing Sheets

PURGE CONTROL DEVICE

TECHNICAL FIELD

This invention relates to a purge control device suitable for use in a vehicle evaporative control system.

BACKGROUND OF THE INVENTION

Evaporative control systems are commonly employed on motor vehicles to reduce emissions of fuel vapor. Generally a storage canister containing activated charcoal adsorbs fuel vapor emitted from the fuel tank. To purge the canister, vacuum from the engine intake manifold draws air through the canister. The air carries the adsorbed fuel vapor into the intake manifold for combustion in the engine. To avoid purging an excess amount of vapor when the vacuum is high, i.e., at idle or light engine load, a purge control device is situated in the vacuum line between the canister and the intake manifold. One type of purge control device is controlled by the engine control module through a pulse width modulated (PWM) signal. The effective flow area of the device is proportional to the duty cycle of the PWM signal. The duty cycle for a given frequency is the ratio of the on time of the signal to the period of the signal expressed as a percent. For current applications this method of purge control is adequate. Future regulations may require a larger canister and therefore, a more rapid canister purge. That would lead to a requirement for improved control of the purge flow, particularly during idle operation of the vehicle when the engine is least capable of consuming the fuel.

SUMMARY OF THE INVENTION

This invention provides an improved device suitable for controlling purge of fuel vapor in a variety of vehicle evaporative control systems.

An engine's ability to consume fuel vapor purged from a canister is largely governed by engine displacement. Therefore, prior devices capable of controlling purge at idle in a large engine may not be capable of controlling purge at idle in a small engine. The purge control device provided by this invention provides adequate control of purge at idle in small engines as well as large engines. Accordingly, this invention obviates the need for separate calibration of a purge control device for small and large engines.

The purge control device provided by this invention comprises two solenoid actuated valves in a single housing to control parallel orifices in the purge flow path. The solenoid valves are integrated into the housing with an electrical connector to connect the solenoids to an electronic control module. The solenoid valves are normally closed and have different orifice sizes to provide different flow capacities. The low flow capacity valve has a small orifice which will pass the maximum amount of purged fuel vapor that a large eight cylinder engine can consume during idle. The high flow capacity valve has a large orifice which will pass sufficient flow at low manifold vacuum, i.e., during wide open throttle or high engine load operation, to purge the canister rapidly.

The flow rate through each orifice is controlled by an electronic control module which regulates the PWM signals to the solenoid controlled valves. Each valve receives its own PWM signal so the flow area of each valve is individually controlled. As a result this invention offers a device that can provide a family of flow curves regulated by an electronic control module and is adaptable to many applications.

The details as well as other features and advantages of a preferred embodiment of this invention are set forth in the remainder of the specification and are shown in the accompanying drawings.

SUMMARY OF THE INVENTION

THE PREFERRED EMBODIMENT

Figure 1:
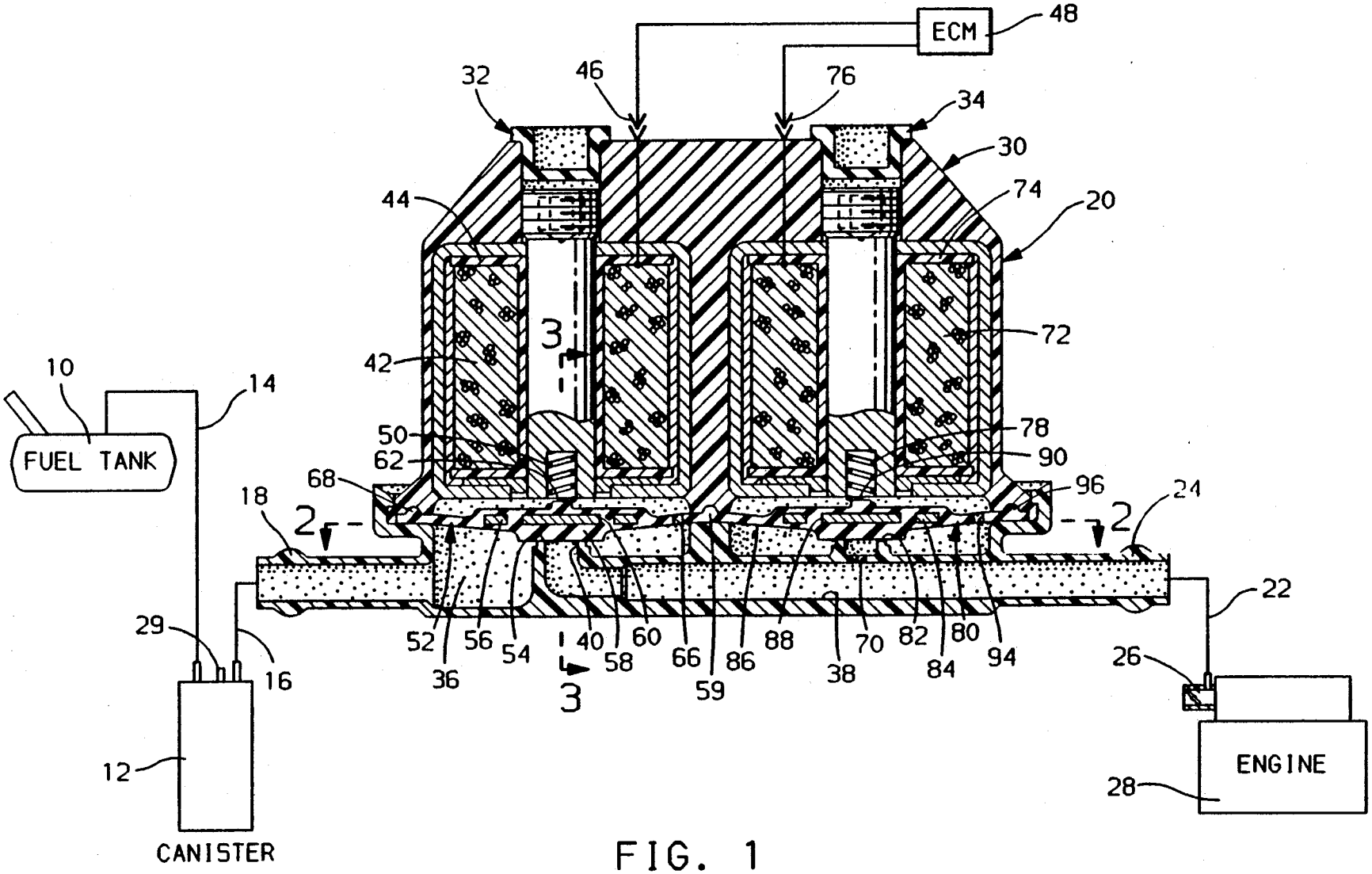
FIG. 1 is a sectional view of a purge control device provided by this invention, shown in a schematic diagram of an evaporative control system.

Referring to the drawings, a fuel tank 10 is connected to a canister 12 by a vent line 14. A first purge line 16 connects the canister 12 to the inlet 18 of a purge control device 20. A second purge line 22 connects the outlet 24 of the purge control device 20 to a source 26 of manifold vacuum in the engine 28. Fuel vapor expelled from tank 10 is directed through vent line 14 to canister 12. Manifold vacuum draws air into canister 12 through fitting 29, and through canister 12, purge line 16, purge control device 20, and purge line 22 to the engine 28. The air flow purges fuel vapor from canister 12 and delivers the fuel vapor to the engine for combustion.

The purge control device 20 comprises a housing 30 which encompasses two solenoid actuated valves 32, 34, an inlet chamber 36, and an exit flow path 38. The first solenoid actuated valve 32 is a high flow capacity valve that controls the passage of vapor through a large orifice 40 sized for flow during high speed engine operation. The high flow capacity valve 32 comprises a solenoid coil 42 wound around a bobbin 44. The coil 42 terminates at a connector 46 which communicates with the electronic control module (ECM) 48. A spring 50 located within an aperture of the solenoid actuated valve 32 biases a magnetically responsive valve member 52 against a seat 54 and thereby closes the orifice 40 which opens from inlet chamber 36 to exit flow path 38.

The magnetically responsive valve member 52 has an iron disk 56 encapsulated by a portion 58 of diaphragm 59. The disk 56 contains apertures 60 spaced from each other to help bond the iron disk 56 to the diaphragm portion 58. A spring locator 62 on the valve member 52 retains the spring 50 above the seat 54. Apertures 66 maintain pressure equilibrium across diaphragm portion 58. A sealing bead 68 seals the valve member 52 to the housing 30.

The orifice 40 of the high flow capacity valve 32 is approximately 5-6 mm. in diameter to allow a high purge flow rate during conditions of wide open throttle or high engine load operation. The flow rate is controlled by the ECM 48 which regulates a duty cycle to the solenoid actuated valve 32.

The low flow capacity solenoid valve 34 controls the purge flow through an orifice 70 sized for flow during idle. The low flow capacity valve 34 comprises a solenoid coil 72 wound around a bobbin 74. The coil terminates at a connector 76 which communicates with the ECM 48. A spring 78 located within an aperture of the solenoid actuated valve 34 biases a magnetically responsive valve member 80 against a seat 82 and thereby closes the orifice 70 which opens from inlet chamber 36 to the exit flow path 38.

The magnetically responsive valve member 80 has an iron disk 84 encapsulated by a portion 86 of diaphragm 59. The disk 84 contains apertures 88 spaced from each other to help bond the iron disk 84 to the diaphragm portion 86. A spring locator 90 on the valve member 80 retains the spring 78 above the seat 82. Apertures 94 maintain pressure equilibrium across diaphragm portion 86. A sealing bead 96 seals the valve member 80 to the housing 30.

Figure 2:
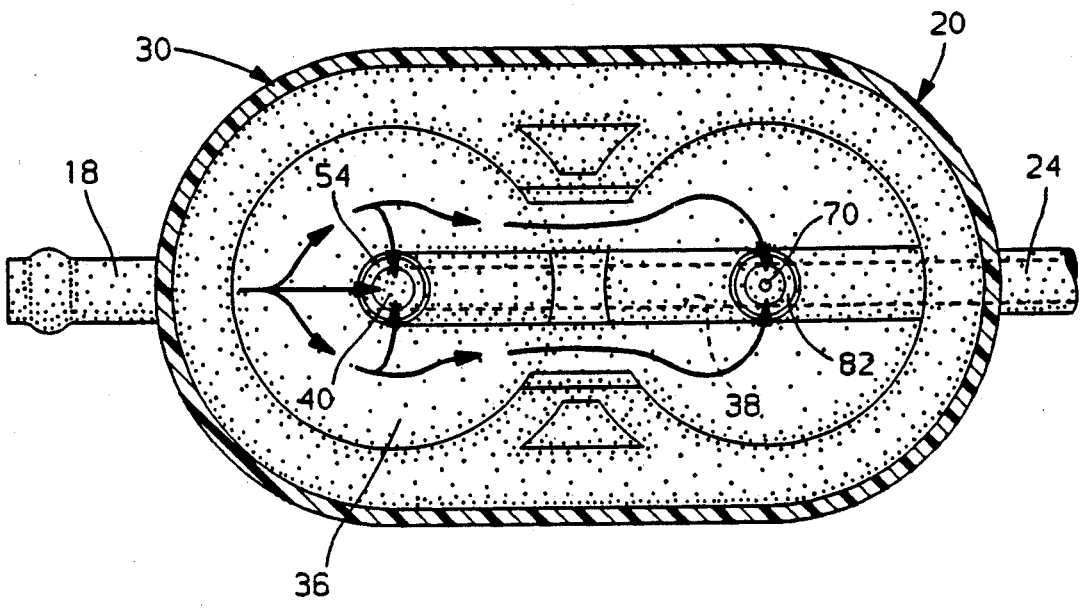
FIG. 2 is a sectional view of the FIG. 1 purge control device; taken along line 2—2 of FIG. 1, showing the vapor flow path in the inlet chamber.
Figure 3:
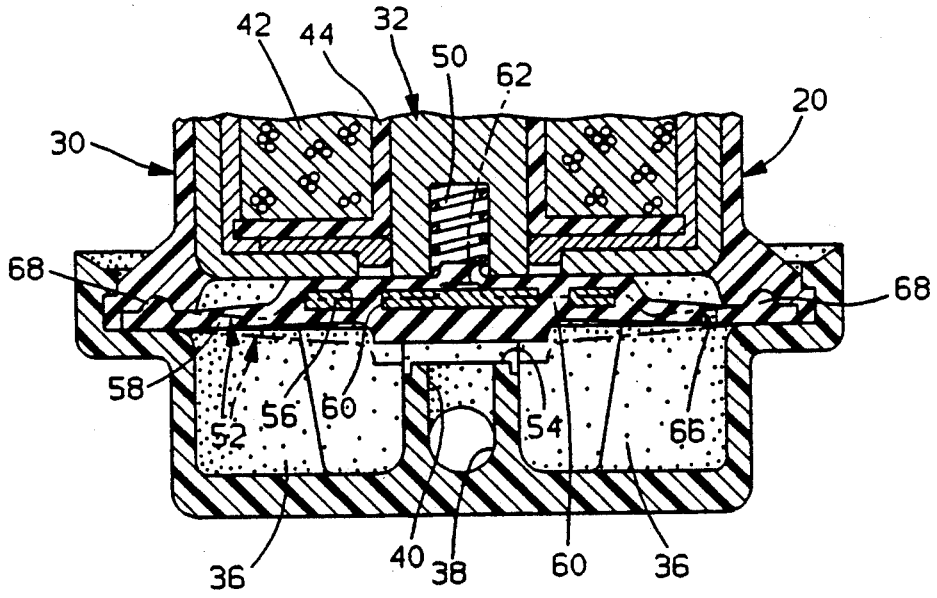
FIG. 3 is a sectional view of the FIG. 1 purge control device; taken along line 3—3 of FIG. 1, showing the open position of the high flow capacity valve, and showing in phantom the closed position of the high flow capacity valve.

FIG. 2 shows the flow path of vapors through the inlet chamber 36, whereby the vapors go either through the high flow orifice 40 or through the low flow orifice 70 or both and then into the exit flow path 38.

Testing indicates that during idle and at 90–100% duty cycle, an eight cylinder engine can consume fuel vapor from the canister 12 when the flow is restricted by an orifice 70 having a 0.5–1.5 mm. diameter. A lower duty cycle would be used to reduce the idle purge flow for a four cylinder engine.

When the solenoid valves 32, 34 are deenergized, the valve members 52, 80 engage their respective seats 54, 82 and obstruct flow through the orifices 40, 70. The ECM 48 monitors appropriate engine operating conditions and generates the appropriate pulse width modulated signal for the solenoid actuated valves 32, 34. Each solenoid is individually energized by the ECM 48 to control the effective purge flow area between the canister 12 and intake manifold vacuum source 26. When the solenoid valves 32, 34 are energized, the respective valve members 52, 80 move against the bias force of the respective springs 50, 78 to allow flow from inlet chamber 36 through the respective orifices 40, 70 to the exit flow path 38 that leads to the intake manifold 26.

Accordingly, the ECM 48 will provide individual duty cycles to each of the two solenoid actuated valves 32, 34 based upon input from various engine sensors. For example, the engine 28 can not handle much vapor from the canister 12 at idle. Therefore, the ECM 48 will provide a duty cycle of 0% to the high flow capacity valve 32, and provide a duty cycle of up to 100% to the low flow capacity valve 34. During high engine speeds, the ECM may provide up to 100% duty cycle to the high flow capacity valve 32 and up to 100% duty cycle to the low flow capacity valve 34. In addition, there can be occurrences, such as a changing from idle to a drive condition where the high 32 and low flow capacity valves 34 will have duty cycles that are ramping up or down individually or in combination.

For each engine application, the duty cycle to the high and low capacity valves 32, 34 can be programmed to provide a predetermined flow curve. This invention thereby provides one purge control device 20 having the capability of adequate flow control for small engines as well as large engines.

The embodiment of the invention in which an exclusive property or privilege is claimed is defined as follows:

1. A purge control device for use in an evaporative control system having a canister for adsorbing fuel vapor evaporated from a fuel tank and a purge line connecting the canister to an engine vacuum source, the purge control device comprising:

a housing adapted to be connected in the purge line between the canister and the vacuum source and including an inlet chamber for receiving the purge flow from the canister, an exit flow path for directing purge flow to the vacuum source, a first solenoid valve for regulating purge flow from the inlet chamber to the exit flow path, a second solenoid valve parallel to the first solenoid valve for regulating purge flow from the inlet chamber to the exit flow path, said first solenoid valve having a first orifice opening from the chamber to the exit flow path, a first valve seat surrounding the first orifice, and a first valve member biased against the first valve seat to inhibit flow from the chamber to the exit flow path through the first orifice, and said second solenoid valve having a second orifice opening from the chamber to the exit flow path, a second valve seat surrounding the second orifice, and a second valve member biased against the second valve seat to inhibit flow from the chamber to the exit flow path through the second orifice, and wherein the second orifice is smaller than the first orifice, whereby the first solenoid valve member opens in response to an electronic signal to permit purge flow from the chamber through the first orifice to the exit flow path and the second solenoid valve member opens in response to another electronic signal to permit purge flow from the chamber through the second orifice to the exit flow path.

2. A purge control device as set forth in claim 1 wherein the first orifice is between approximately 5 and 6 mm. in diameter to allow a high purge flow rate during preselected conditions, and the second orifice is between approximately 0.5 and 1.5 mm. in diameter to allow a low purge flow rate during other preselected conditions.

3. A purge control device as set forth in claim 1 wherein the first and second valve members are iron disks encapsulated in diaphragms.

* * * * *